US006029852A

United States Patent [19]

Rochman

[11] Patent Number: 6,029,852

[45] Date of Patent: Feb. 29, 2000

[54] DEVICE FOR DISPENSING CARD-LIKE MEDIA

[76] Inventor: Marc Rochman, 890 Coral Ridge Dr., Coral Springs, Fla. 33071

[21] Appl. No.: 09/004,518

[22] Filed: Jan. 8, 1998

[51] Int. Cl.[7] ..... B65G 59/00

[52] U.S. Cl. ..... 221/102; 221/98; 221/198; 221/281; 221/283; 221/303; 221/279

[58] Field of Search ..... 312/60, 61; 221/34, 221/46, 59, 62, 6, 2, 102, 97, 98, 197, 198, 281, 282, 283, 287, 286, 303, 306, 309, 279, 280

[56] References Cited

U.S. PATENT DOCUMENTS

| | | | |
|---|---|---|---|
| 897,996 | 9/1908 | O'Leary | 221/34 |
| 905,993 | 12/1908 | Dabney et al. | 312/61 |
| 1,128,566 | 2/1915 | Yeaticks | 312/61 |
| 1,682,580 | 8/1928 | Pratt | 312/61 |
| 2,065,607 | 12/1936 | Morgan | 221/102 |
| 3,514,014 | 5/1970 | Skowronski | 221/46 |
| 5,123,551 | 6/1992 | King | 221/34 |

FOREIGN PATENT DOCUMENTS

| | | | |
|---|---|---|---|
| WO 94/22350 | 10/1994 | WIPO | 221/279 |

*Primary Examiner*—H. Grant Skaggs

[57] ABSTRACT

A device for dispensing card-like media, referred to as "cards", from a stack of such cards has a front-loading magazine for storing and dispensing the cards, the magazine being received within a primary aperture of a housing. The magazine has a casing formed by two lateral walls and a base and having a mechanism for biasing the stack of cards towards its front opening. A front cover, attached to the casing near its front end, retains the stack of cards within the casing and provides a slot shaped to facilitate manual removal of a single card from the stack. The front cover is displaceable between a closed position in which the front cover closes most of the front opening and an open position in which the front cover allows front loading of the cards into the casing. The open position is such that the front cover forms a partial obstruction to the front opening so as to retain the stack of cards within the cavity.

10 Claims, 3 Drawing Sheets

DEVICE FOR DISPENSING CARD-LIKE MEDIA

FIELD AND BACKGROUND OF THE INVENTION

The present invention relates to devices for storing and dispensing items and, in particular, it concerns a device for dispensing card-like media.

It is known to provide various devices for dispensing cards and the like. Most of the devices used in game playing establishments are gravity fed and are loaded from the rear, i.e., the end of the device remote from the point of dispensing.

For business cards, leaflets and documents which are intended to be available for manual, self-service dispensing, specialized dispensing devices are not in common use.

There is therefore a need for an easy-to-load device for dispensing card like media. It would also be advantageous to provide a versatile dispensing device which would be suitable both for desktop and wall-mounted use.

SUMMARY OF THE INVENTION

The present invention is a device for dispensing card-like media.

According to the teachings of the present invention there is provided, a device for dispensing card-like media, referred to as "cards", from a stack of such cards, the device comprising: (a) a front-loading magazine for storing and dispensing the cards, the magazine having: (i) a casing including two lateral walls and a base defining therebetween an elongated cavity for storing the stack of cards, one end of each of the lateral walls and the base defining a front opening of the casing, the casing having means for biasing the stack of cards towards the front opening, and (ii) a front cover attached to the casing near the front end so as to retain the stack of cards within the casing, the front cover having a slot shaped to facilitate manual removal to a single card from the stack, the front cover being displaceable between a closed position in which the front cover substantially closes the front opening and an open position in which the front cover allows front loading of the cards into the casing, the open position being such that the front cover forms a partial obstruction to the front opening so as to retain the stack of cards within the cavity; and (b) a housing having a primary aperture for receiving the magazine.

According to a further feature of the present invention, the means for biasing includes: (a) an impeller plate having a front surface deployed substantially perpendicular to a direction of feeding of the cards for pressing against the stack of cards, the impeller plate being slidably mounted within the casing through a slidable mounting configured to allow sliding of the impeller plate substantially parallel to the feed direction while resisting rotation of the impeller plate about an axis perpendicular to the feed direction, and (b) a spring element for biasing the impeller plate towards the front opening of the casing.

According to a further feature of the present invention, the impeller plate features a backplate and a substantially transparent front cover configured to allow insertion of an information card within the impeller plate so as to be visible when the stack of cards is exhausted.

According to a further feature of the present invention, the front cover is hingedly connected to the casing, an axis of rotation of the hinged connection overlapping the front opening.

According to a further feature of the present invention, the housing has a secondary aperture communicating with an internal volume and configured to provide drop-in storage for received cards.

According to a further feature of the present invention, the housing is adapted for both desktop and wall-mounted use, the magazine and the primary aperture being configured such that the magazine is receivable within the primary aperture in a first orientation for table top use and a second orientation rotated through 180° about the feed direction relative to the first orientation for wall-mounted use.

According to a further feature of the present invention, the housing has a secondary aperture communicating with an internal volume, the secondary aperture being provided with a cover featuring a slot configured to allow drop in storage for received cards and a region for displaying visible information, wherein the cover is invertible such that the region for displaying visible information may readily be correctly orientated for desktop and wall-mounted use.

According to a further feature of the present invention, the housing further features a hinged door element openable to provide access to the internal volume for removing the received cards, wherein the door element is configured so as to retain the received cards when the door element is opened both during desktop and wall-mounted use.

According to a further feature of the present invention, there is also provided an additional cover for concealing the secondary aperture when the drop-in storage is not required.

There is also provided according to a further feature of the present invention, a modular system for dispensing cards, the system providing capabilities of mounting on either a horizontal surface or on a wall, the system comprising: (a) the device as described above; and (b) a frame defining an aperture similar to the primary aperture, the frame being configured for mounting on the wall to serve as an alternative housing for receiving the magazine.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a device for dispensing card-like media.

The principles and operation of devices according to the present invention may be better understood with reference to the drawings and the accompanying description.

Figure 1:
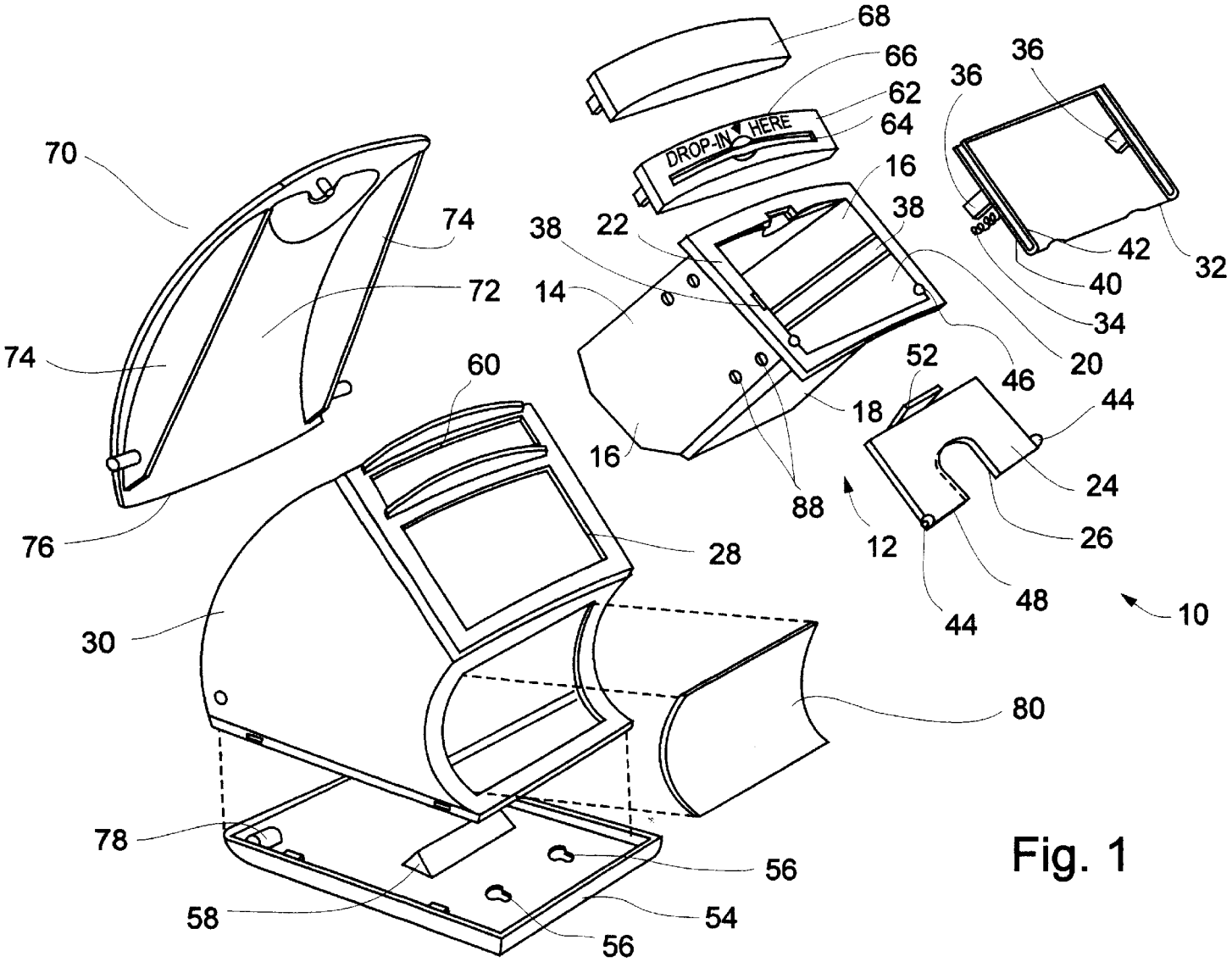
FIG. 1 is an exploded isometric view of a device for dispensing card-like media, constructed and operative according to the teachings of the present invention.

Referring now to the drawings, FIG. 1 shows a device, generally designated 10, constructed and operative according to the teachings of the present invention, for dispensing card-like media from a stack of such media. For ease of reference, the card-like media will be referred to simply as "cards"

Generally speaking, device 10 includes a front-loading magazine 12 for storing and dispensing the cards which is received within the primary aperture 28 of a housing 30. Magazine 12 has a casing 14 formed at least from two lateral walls 16 and a base 18 which define therebetween an elongated cavity 20 for storing the stack of cards. One end of each of lateral walls 16 and base 18 define a front opening 22 of casing 14. Casing 14 also features means for biasing the stack of cards towards front opening 22.

Attached to casing 14 near front opening 22 is a front cover 24 which retains the stack of cards within the casing. A slot 26 in front cover 24 is shaped to facilitate manual removal of a single card from the stack. Front cover 24 is displaceable between a closed position in which it substantially closes front opening 22 and an open position in which it allows front loading of the cards into casing 14. It is a particular feature of most preferred embodiments of the present invention that, in its open position, front cover 24 forms a partial obstruction to front opening 22 so as to retain the stack of cards within cavity 20.

It should be noted that the present invention may be used to advantage with a wide range of card-like media. The phrase "card-like media" is used herein in the description and claims to refer to any substantially flat, typically rectangular items which are to be stored together and dispensed individually. Examples of such media include, but are not limited to, business cards, leaflets, forms, postcards, coupons and other documents. It is also important to note that the invention may be used with both with cards of flexible materials such as paper-based card and relatively stiff cards such as credit cards. It should also be clear that the word "card" as used herein does not imply any specific requirement as to the composition of the material (wood-pulp content or the like).

The device of the present invention is described as a "dispenser". It should be understood that the word "dispenser" is used herein to refer to any device which stores media in a manner which permits their individual removal. The "dispenser" word as used herein does not in any way imply an active mechanism for displacing the media. In fact, the preferred embodiment of the device described herein is a manual dispenser in which the card-like media are removed by movement of the user's finger within slot 26 while the device is essentially passive.

Turning now to the features of the present invention in more detail, the means for biasing the cards towards front opening 22 typically includes an impeller plate 32 which is urged forward towards front opening 22 by a spring element 34. Impeller plate 32 has a front surface deployed substantially perpendicular to the feed direction of the cards for pressing against the stack of cards. Impeller plate 32 is slidably mounted within casing 12 through a slidable mounting which allows sliding of the impeller plate substantially parallel to the feed direction while resisting rotation of the impeller plate about an axis perpendicular to the feed direction. In the implementation shown here, this is achieved by elongated slide blocks 36, attached to opposite edges of impeller plate 32, which engage corresponding guide slots 38 in the inner faces of lateral walls 16.

The phrase "feed direction" is used herein in the description and claims to refer to the direction in which cards advance within device 10 so as to replace cards which have been dispensed. Typically, the feed direction corresponds to a line of intersection between one of lateral walls 16 and base 18, although internal features of lateral walls 16 and base 18 may define a slightly different feed direction.

Preferably, impeller plate 32 is formed with a backplate 40 and a substantially transparent front cover 42. Typically, both backplate 40 and transparent front cover 42 are conveniently formed as a unitary, "folded" structure molded from transparent molded plastic material. This arrangement is configured to allow insertion of an information card, for example, a sample business card or an "EMPTY" message, within the impeller plate. The inserted information card becomes visible when the stack of cards stored within magazine 12 is exhausted.

As mentioned above, it is a particular feature of most preferred embodiments of the present invention that, in its open position, front cover 24 forms a partial obstruction to front opening 22 so as to retain the stack of cards within cavity 20. This may readily be achieved by attaching front cover 24 to casing 14 through a hinged connection the axis of which overlaps front opening. Thus, front cover 24 is shown here with two lateral hinge pins 44 configured to engage hinge sockets 46 formed in lateral walls 16 at opposite sides of front opening 22. Preferably, hinge pins 44 are close to a lower edge 48 of front cover 24. Hinge sockets 46, on the other hand, are preferably slightly removed from the lower edge of front opening 22 so as to form a dispensing slit 50 (see FIG. 2) through which cards are dispensed. A catch 52 is provided for retaining front cover 24 in its closed position within front opening 22.

The hinge structure described ensures that lower edge 48 remains in approximately the same position overlapping front opening 22 while front cover 24 is rotated between its closed position and its open position. This facilitates front loading of magazine 12 by retaining impeller plate 32 and any remaining cards in cavity 20 so that they are not pushed out as front cover 24 is opened. Instead, they remain neatly tucked behind lower edge 48 and can readily be pushed backwards against spring element 34 as additional cards are inserted.

It is a further preferred feature of certain embodiments of the present invention that housing 30 is adapted for both desktop and wall-mounted use. Accordingly, as shown in FIG. 1, housing 30 typically has a base 54 which has features, for example keyhole slots 56 shown here for suspending housing 30 from a wall. The underside of base 54 preferably features rubber feet (not shown) or the like for desktop use. Base 54 may be as separate element as shown, or may be integrally formed with the rest of housing 30.

Figure 2:
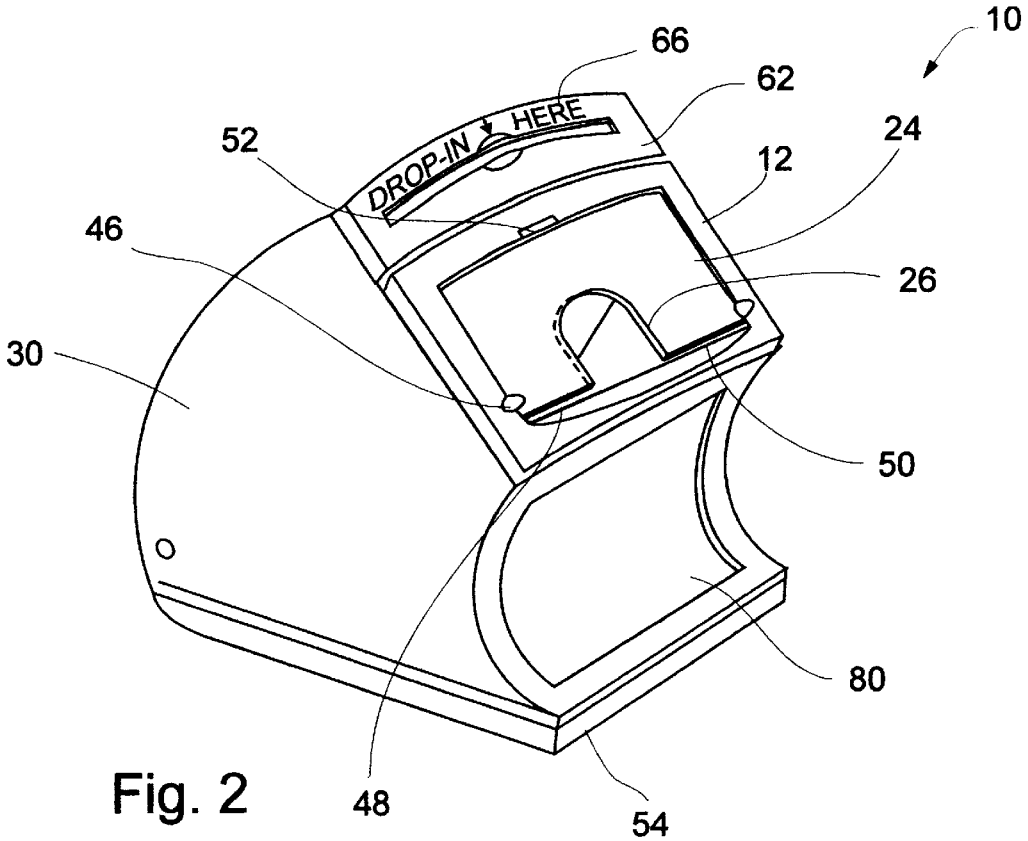
FIG. 2 is an assembled isometric view of the device of FIG. 1 configured for desktop use.
Figure 3A:
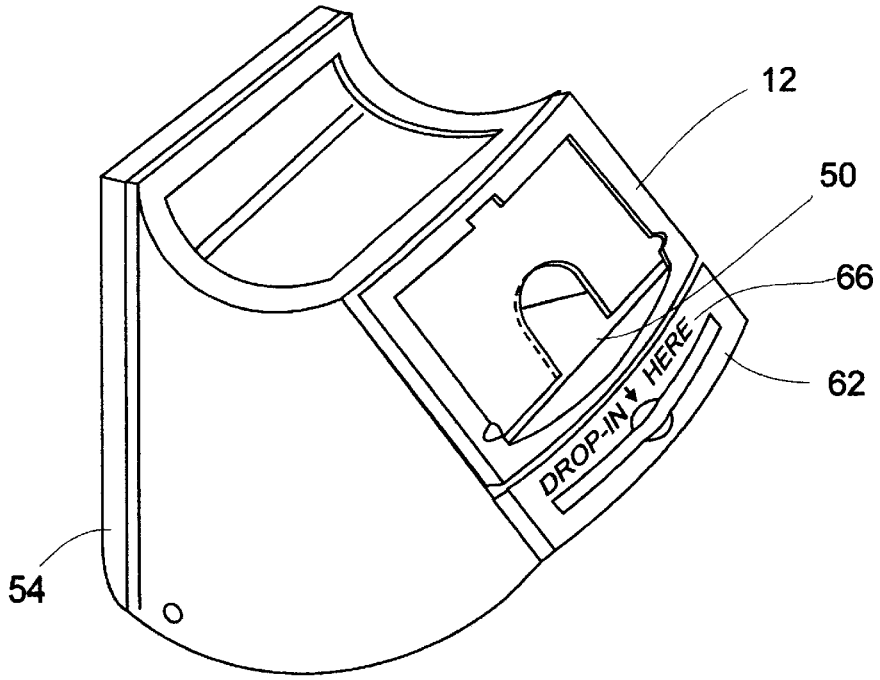
FIG. 3A is an assembled isometric view of the device of FIG. 1 configured for wall-mounted use.

To accommodate these two modes of use, magazine 12 and primary aperture 28 are preferably configured such that the magazine is invertible relative to the housing. In other words, magazine 12 is receivable within primary aperture 28 in a first orientation as shown in FIG. 2 for table top use, and in a second orientation as shown in FIG. 3A for wall-mounted use. Relative to housing 30, the second orientation is rotated through 180° about the feed direction from the first orientation.

In order to make removal of cards as convenient as possible, primary aperture 28 is preferably orientated such that the feed direction of magazine 12 when inserted is between about 30° and about 80°. and typically between about 45° and about 70°, from the general plane of base 54. Magazine 12 is preferably supported and stabilized in its inserted position by internal features of housing 30 such as the inner surface of base 54 and support ridge 58.

A further set of features of certain preferred embodiments of the present invention relate to the provision of drop-in storage for card-like media received by the user. To this end, housing 30 preferably has a secondary aperture 60 communicating with an internal volume defined here as the volume of the rear part of housing 30 which is not occupied by magazine 12. This allows device 10 to serve as a double purpose device, simultaneously providing a supply of card-like media to be dispensed and storing incoming card-like media. In the context of use with business cards, this is particularly useful for the customary exchange of business cards which has become almost ritual at conferences, fairs and meetings of many types. Cards received can simply be dropped in through secondary aperture 60 and are stored conveniently and tidily within the internal space of housing 30 to be removed for processing, filing or discreet disposal at a later time.

Secondary aperture 60 is typically provided with a cover 62 which has a slot 64 configured to allow drop-in storage for received cards and, optionally, also a region 66 for displaying visible information. In the case that device 10 is adapted for both desktop and wall-mounted use, cover 62 is preferably invertible such that the visible information of region 66 may readily be correctly orientated for desktop and wall-mounted use as indicated in FIGS. 2 and 3A. Optionally, an additional non-slotted cover 68 may be provided to replace cover 62 so as to conceal secondary aperture 60 when the drop-in storage feature is not required.

Figure 3B:
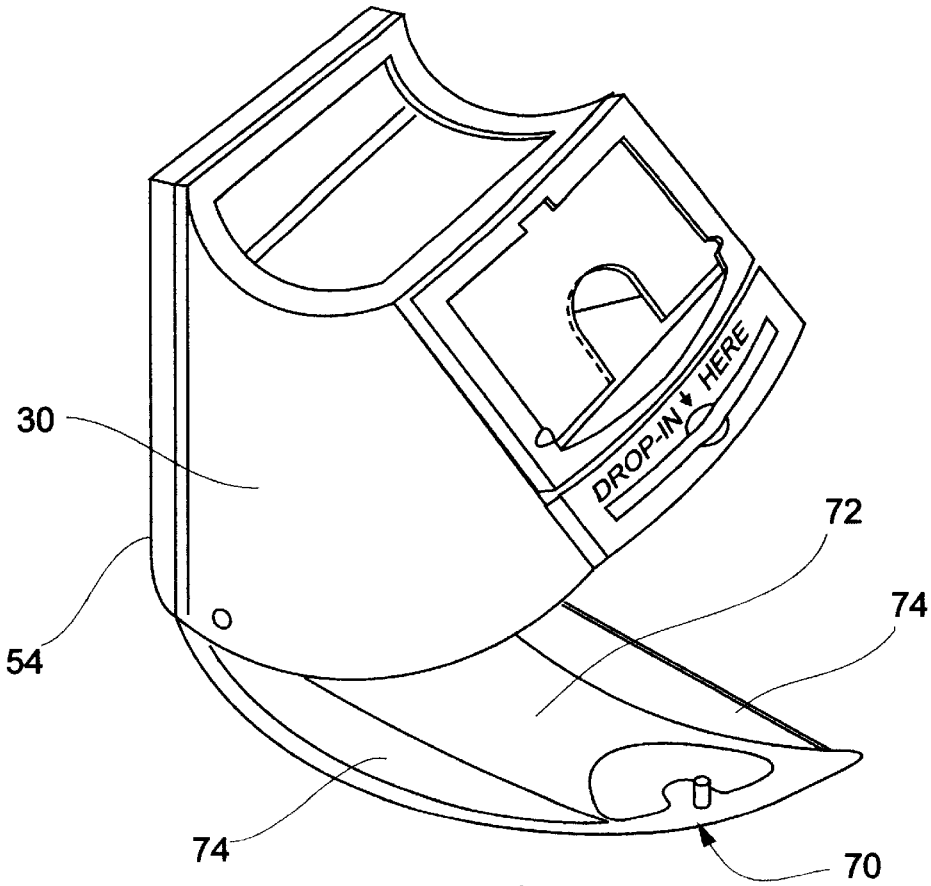
FIG. 3B is similar to FIG. 3A but shows an open position of a door in a housing of the device.

For convenient removal of received cards, housing 30 preferably has a hinged door element 70 which may be opened to provide access to the internal volume. A preferred form of door element 70 is best seen in FIGS. 1 and 3B. Here, door element 70 is configured so that it will retain the received cards when the door element is opened both during desktop and wall-mounted use.

More specifically, door element 70 is preferably formed with a concave inner surface 72 and side walls 74. A back edge 76 of the door element is configured to abut at least one stop 78 formed on base 54 so as to delimit the fully open position of door element 70. The significance of this structure is best understood from FIG. 3B which shows the fully open position of door element 70 when device 10 is used in its wall-mounted configuration. The shape of door element 70 together with the stop arrangement ensure that the fully open position of the door element provides an upward gradient towards its edges, thereby retaining the cards when the door element is opened until the) are manually removed. Clearly, the geometry of the open position of door element 70 also effectively retains the received cards when device 10 is used in its desktop mode.

Finally with respect to housing 30, one or more display panel 80 may be provided for displaying visible information such as advertising material and the like. Panel 80 may be any type of display panel, for example, printed matter or an electronic display. Panel 80 is preferably invertible or otherwise adapted to enable inverted display of the visible information.

Figure 4:
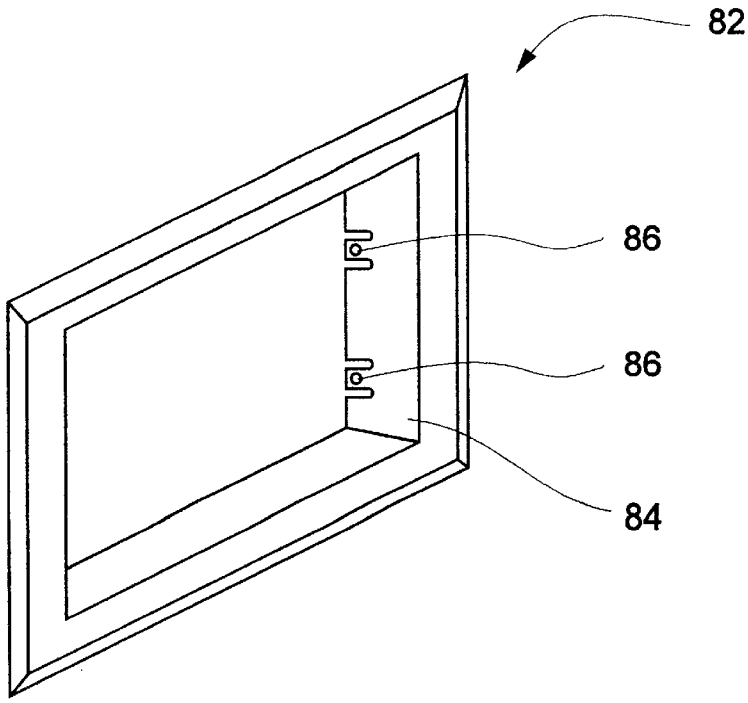
FIG. 4 is an isometric view of a frame for use as an alternative wall-mounting in a modular system for dispensing card-like media according to the present invention.

Referring now additionally to FIG. 4, there is shown an additional mounting option which may be provided as part of a modular system for dispensing cards according to the present invention. Specifically, the additional mounting option employs a frame 82 which defines an aperture 84 generally similar to primary aperture 28 described above. Frame 82 is configured for mounting on a wall over a suitable hole to serve as an alternative housing for receiving magazine 12. Preferably, in order to retain magazine 12 firmly, frame 82 has a number of self-locking catches 86 which engage corresponding recesses 88 in lateral walls 16 of magazine 12. These self locking catches may provide a semi-permanent attachment of magazine 12 within frame 82 for long-term use.

It will be appreciated that the above descriptions are intended only to serve as examples, and that many other embodiments are possible within the spirit and the scope of the present invention.

What is claimed is:

1. A device for dispensing card-like media referred to as "cards", from a stack of such cards, the device comprising:

(a) a front-loading magazine for storing and dispensing the cards said magazine having:

(i) a casing including two lateral walls and a base defining therebetween an elongated cavity for storing the stack of cards, one end of each of said lateral walls and said base defining a front opening of said casing, said casing having means for biasing the stack of cards towards said front opening, and (ii) a front cover attached to said casing near said front end so as to retain the stack of cards within said casing, said front cover having a slot shaped to facilitate manual removal of a single card from the stack said front cover being displaceable between a closed position in which said front cover substantially closes said front opening and an open position in which said front cover allows front loading of the cards into said casing, said open position being such that said front cover forms a partial obstruction to said front opening so as to retain the stack of cards within said cavity; and (b) a housing having a primary aperture for receiving said magazine.

2. The device of claim 1, reference being made to a "feed direction" defined as a line of intersection between one of said lateral walls and said base, wherein said means for biasing includes:

(a) an impeller plate having a front surface deployed substantially perpendicular to said feed direction for pressing against the stack of cards, said impeller plate being slidably mounted within said casing through a slidable mounting configured to allow slidingly of said impeller plate substantially parallel to said feed direction while resisting rotation of said impeller plate about an axis perpendicular to said feed direction, and (b) a spring element for biasing said impeller plate towards said front opening of said casing.

3. The device of claim 2, wherein said impeller plate features a backplate and a substantially transparent front cover configured to allow insertion of an information card within said impeller plate so as to be visible when the stack of cards is exhausted.

4. The device of claim 1, wherein said front cover is hingedly connected to said casing, an axis of rotation of said hinged connection overlapping said front opening.

5. The device of claim 1, wherein said housing has a secondary aperture communicating with an internal volume and configured to provide drop-in storage for received cards.

6. The device of claim 1, reference being made to a "feed direction" defined as a line of intersection between one of said lateral walls and said base, wherein said housing is adapted for both desktop and wall-mounted use, said magazine and said primary aperture being configured such that said magazine is receivable within said primary aperture in a first orientation for table top use and a second orientation rotated through 180° about a line parallel to said feed direction relative to said first orientation for wall-mounted use.

7. The device of claim 6, wherein said housing has a secondary aperture communicating with an internal volume, said secondary aperture being provided with a cover featuring a slot configured to allow drop-in storage for received cards and a region for displaying visible information, wherein said cover is invertible such that said region for displaying visible information may readily be correctly orientated for desktop and wall-mounted use.

8. The device of claim 7, wherein said housing further features a hinged door clement openable to provide access to said internal volume for removing the received cards, wherein said door element is configured so as to retain the received cards when said door element is opened both during desktop and wall-mounted use.

9. The device of claim 7, further comprising an additional cover for concealing said secondary aperture when said drop-in storage is not required.

10. A modular system for dispensing cards, the system providing capabilities of mounting on either a horizontal surface or on a wall, the system comprising:

(a) the device of claim 1; and (b) a frame defining an aperture similar to said primary aperture, said frame being configured for mounting on the wall to serve as an alternative housing for receiving said magazine.

* * * * *